US007639107B2

(12) United States Patent
Ohkubo et al.

(10) Patent No.: US 7,639,107 B2
(45) Date of Patent: Dec. 29, 2009

(54) OVERCURRENT RELAY

(75) Inventors: Hideaki Ohkubo, Tokyo (JP); Tomokazu Sakamoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 397 days.

(21) Appl. No.: 10/574,473

(22) PCT Filed: Apr. 20, 2005

(86) PCT No.: PCT/JP2005/007535

§ 371 (c)(1),
(2), (4) Date: Apr. 3, 2006

(87) PCT Pub. No.: WO2006/114870

PCT Pub. Date: Nov. 2, 2006

(65) Prior Publication Data

US 2008/0272866 A1 Nov. 6, 2008

(51) Int. Cl.
*H01H 51/22* (2006.01)

(52) U.S. Cl. ..... 335/78

(58) Field of Classification Search ..... 335/78
See application file for complete search history.

(56) References Cited

U.S. PATENT DOCUMENTS 4,587,502 A * 5/1986 Matsuo et al. ..... 335/85
4,665,375 A * 5/1987 Weiser ..... 335/78
4,933,654 A * 6/1990 Hori et al. ..... 335/78
5,283,553 A * 2/1994 Ishii et al. ..... 340/664
5,910,759 A * 6/1999 Passow ..... 335/78
5,920,451 A * 7/1999 Fasano et al. ..... 361/45
5,956,221 A * 9/1999 Zuzuly et al. ..... 361/102
5,959,518 A * 9/1999 Passow ..... 335/78
5,994,987 A * 11/1999 Passow ..... 335/78
6,020,801 A * 2/2000 Passow ..... 335/78
6,025,766 A * 2/2000 Passow ..... 335/78

FOREIGN PATENT DOCUMENTS

JP 5-79852 U 10/1993
JP 2001-520795 A 10/2001
JP 2002-516457 A 6/2002
JP 2002-543552 A 12/2002
JP 2003-526178 A 9/2003

* cited by examiner

*Primary Examiner*—Elvin G Enad
*Assistant Examiner*—Alexander Talpalatskiy
(74) *Attorney, Agent, or Firm*—Sughrue Mion, PLLC

(57) ABSTRACT

It is an object to provide is an overcurrent relay having less number of parts and a smaller space to implement an automatic reset function and a manual reset function.

A contact point mechanism 110 includes a movable contactor support 10 for supporting a movable contactor composing a part of the usually-closed contact point while being maintained in the movable iron core 5, and a reset bar 14 arranged in a manner that is switchable between an automatic reset setting and a manual reset setting. The reset bar 14 does not engage with the movable contactor support 10 in an operation range of the movable contactor support 10 in the automatic reset setting. In addition, the reset bar 14 engages with the movable contactor support 10 in interlock with the movable iron core 5 to interrupt the reset operation of the movable iron core 5 of the electromagnet 109 in the manual reset setting, and, when the reset operation is manually performed, engages with the movable contactor support 10 to be moved up to a position at which the reset operation is completed.

3 Claims, 13 Drawing Sheets

DETAIL
DRAWING Z

OVERCURRENT RELAY

TECHNICAL FIELD

The present invention relates to an overcurrent relay for protecting such as a motor from overload and so on.

BACKGROUND ART

A conventional overcurrent relay has a function for opening a usually-closed contact point of an internal contact mechanism and closing a usually-opened contact point of the internal contact point mechanism through a so-called trip operation such that a load such as a motor is stopped by intercepting a main circuit using an electromagnetic contactor and the like when there occurs abnormality such as a case where an overcurrent flows into the main circuit or a case where a main three phase circuit has a defective phase, a function for restoring the internal contact point mechanism to a stationary state by manually closing the usually-closed contact point of the internal contact mechanism and opening the usually-opened contact point after the trip operation, which is also called a manual reset, and a function for restoring the internal contact point mechanism to a stationary state by automatically closing the usually-closed contact point of the internal contact mechanism and opening the usually-opened contact point after a predetermined period of time elapses, which is also called an automatic reset. In addition, the overcurrent relay has a structure switchable between the automatic reset and the manual reset.

In addition, the conventional overcurrent relay is classified into an external power feeding method for supplying driving power through a separate power line other than a main circuit power line and a self-power feeding method for supplying driving power through the main circuit power line using a current transformer (CT).

In an overcurrent relay employing the self-power feeding method, when current does not flow into a coil installed in an electromagnetic contactor according to a trip operation performed by the overcurrent relay, magnetization of the coil is released and the electromagnetic contactor intercepts an electrical connection from a power source of the main circuit to a load. Thereafter, if an internal electric circuit and a magnetic circuit of the overcurrent relay are not configured in such a manner that the automatic reset is distinguishable from the manual reset, when a predetermined period of time elapses, the overcurrent relay closes a usually-closed contact point of an internal contact point mechanism and opens a usually-opened contact point of the internal contact point mechanism automatically, even when the manual reset is set, in the same manner as when the automatic reset is set.

Accordingly, when the manual reset is set, a mechanical configuration is required to prevent the above-mentioned operation. As an example, Japanese Patent Application Publication No. 2001-520795 discloses a trip mechanism allowing switching between the manual reset and the automatic reset. As described in this publication, the trip mechanism allowing switching between the manual reset and the automatic reset prevents the operation of automatically closing a usually-closed contact point of an internal contact point mechanism and opening a usually-opened contact point of the internal contact point mechanism electrically and magnetically, even when the manual reset is set, and allows a reset operation to be performed only when the manual reset is set.

Patent Document 1: PCT Japanese Translation Patent Publication No. 2001-520795

DISCLOSURE OF THE INVENTION

Problems that the Invention is to Solve

Since the overcurrent relay requires the trip mechanism allowing switching between the manual reset and the automatic reset prevents the operation of automatically closing a usually-closed contact point of an internal contact point mechanism and opening a usually-opened contact point of the internal contact point mechanism electrically and magnetically, even when the manual reset is set, and allows a reset operation to be performed only when the manual reset is set, and also the trip mechanism requires at least three parts including a reset bar, a spring pressing the reset bar, and a torsion spring, there arises a problem of a complex configuration and a large space for mechanical configuration.

The invention has been made to overcome the above problem, and it is an object of the invention to provide an overcurrent relay having the less number of parts and hence a smaller space to implement an automatic reset function and a manual reset function.

Means for Solving the Problems

According to the invention, an overcurrent relay includes a calculating part for outputting a trip signal or a reset signal to instruct supply and non-supply of power based on current information of a main circuit current supplied to a load; a power source for supplying power to a coil based on the trip signal or the reset signal when the trip signal or the reset signal is input to the power source; an electromagnet for performing a trip operation to move a movable iron core from a position of a stationary state to a position of a trip state and a reset operation to move the movable iron core from the position of the stationary state to the position of the trip state, the movable iron core including the coil and forming a magnetic circuit when the power is supplied from the power source to the coil based on the trip signal or the reset signal; and a contact point mechanism for opening a usually-closed contact point through the trip operation of the movable iron core and closing the usually-closed contact point through the automatic or manual reset operation. The contact point mechanism includes a movable contactor support for supporting a movable contactor composing a part of the usually-closed contact point while being maintained in the movable iron core; and a reset bar arranged in a manner that is switchable between an automatic reset setting and a manual reset setting. The reset bar does not engage with the movable contactor support in an operation range of the movable contactor support in the automatic reset setting. In addition, the reset bar engages with the movable contactor support in interlock with the movable iron core to interrupt the reset operation of the movable iron core of the electromagnet in the manual reset setting, and, when the reset operation is manually performed, engages with the movable contactor support to be moved up to a position at which the reset operation is completed.

ADVANTAGE OF THE INVENTION

Since the overcurrent relay of the invention includes a calculating part for outputting a trip signal or a reset signal to instruct supply and non-supply of power based on current information of a main circuit current supplied to a load; a power source for supplying power to a coil based on the trip signal or the reset signal when the trip signal or the reset signal is input to the power source; an electromagnet for performing a trip operation to move a movable iron core from a position of a stationary state to a position of a trip state and a reset operation to move the movable iron core from the position of the stationary state to the position of the trip state, the movable iron core including the coil and forming a magnetic circuit when the power is supplied from the power source to the coil based on the trip signal or the reset signal; and a contact point mechanism for opening a usually-closed contact point through the trip operation of the movable iron core and closing the usually-closed contact point through the automatic or manual reset operation, and further, the contact point mechanism includes a movable contactor support for supporting a movable contactor composing a part of the usually-closed contact point while being maintained in the movable iron core; and a reset bar arranged in a manner that is switchable between an automatic reset setting and a manual reset setting, and, the reset bar does not engage with the movable contactor support in an operation range of the movable contactor support in the automatic reset setting, and engages with the movable contactor support in interlock with the movable iron core to interrupt the reset operation of the movable iron core of the electromagnet in the manual reset setting, and, when the reset operation is manually performed, engages with the movable contactor support to be moved up to a position at which the reset operation is completed, it is possible to provide an overcurrent relay having less number of parts and a smaller space to implement an automatic reset function and a manual reset function.

DESCRIPTION OF THE REFERENCE NUMERALS AND SIGNS

1: case, 1*a*: hole, 1*b*: groove, 1*c*: angled hole, 1*ba*: left end of groove 1*b*, 1*bb*: central portion of groove 1*b*, 1*bc*: right end of groove 1*b*, 1*da*: wall of case 1,

1*db*: wall of case, 1*e*: wall of case, 1*f*: wall of case, 2: CT receptacle, 3: capacitor, 4: fixed iron core,

5: movable iron core, 5*a*: narrow part, 6: permanent magnet, 7: movable iron core axis, 7*a*: groove, 8: coil, 8*a*: trip coil, 8*b*: reset coil, 9: spring, 10: movable contactor support, 10*a* to 10*h*: protrusions, 10*i* to 10*j*: windows,

11: movable contactor, 12: fixed contactor, 13: spring, 14: reset bar, 15: spring, 16: variable resistor,

101: power source, 102: load, 103: main circuit, 104: CT, 105: rectifying part, 106: power source, 107: calculating part, 108: operation current adjusting part, 109: electromagnet, 110: contact point mechanism, 111: electronic contactor, 112: overcurrent relay

BEST MODE FOR CARRYING OUT THE INVENTION

Now, best mode for carrying out the invention will be described in Embodiment 1 of the invention.

Embodiment 1

First, a configuration of an overcurrent relay will be described.

Figure 1:
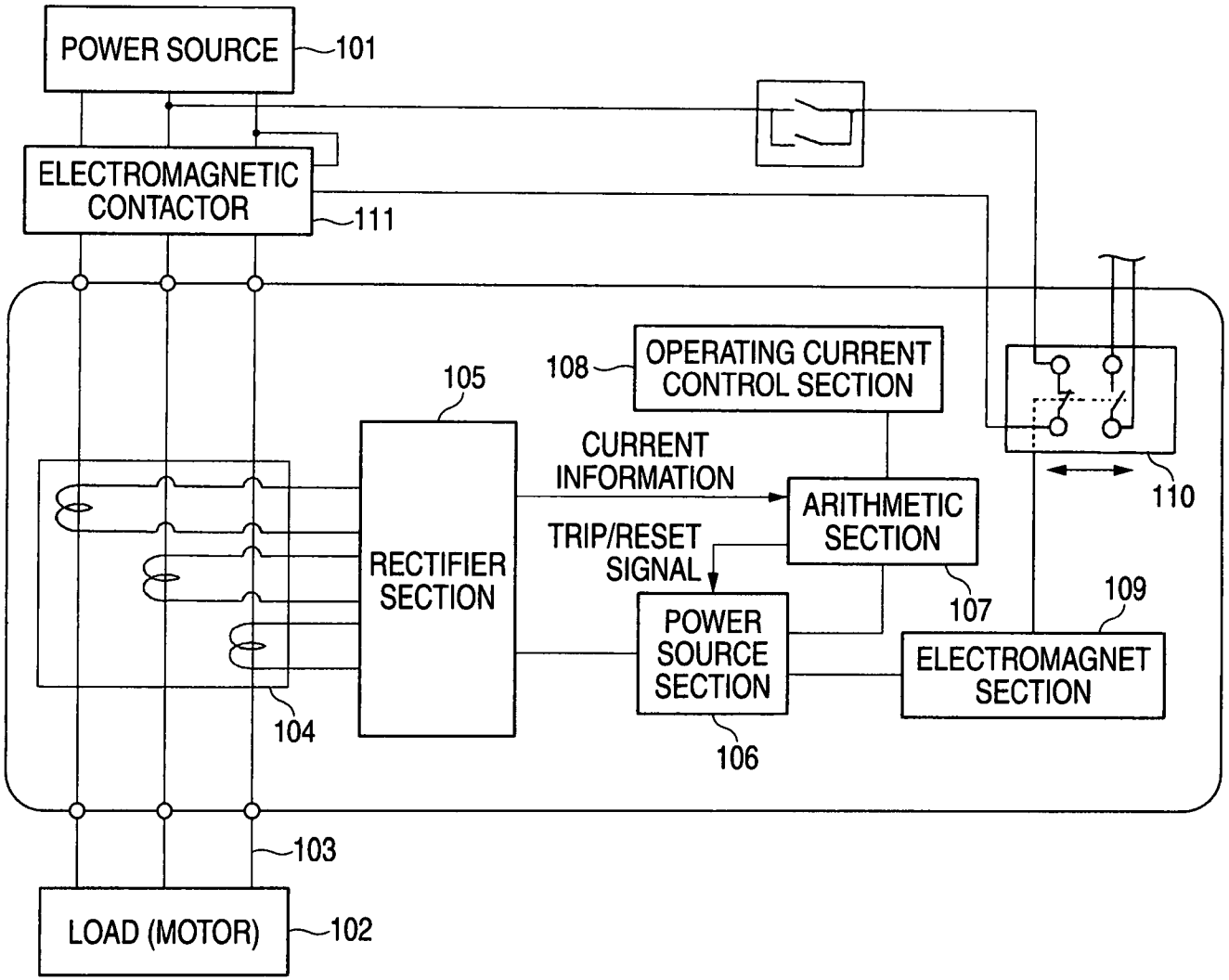
FIG. 1 A view showing configuration of an overcurrent relay according to Embodiment 1 of the invention.

FIG. 1 is a view showing the configuration of an overcurrent relay according to Embodiment 1 of the invention. An electromagnetic contactor 111 is arranged in a main circuit 103 between a power source 101 and a load 102 such as a motor.

As shown by a dashed line in FIG. 1, an overcurrent relay 112 includes a current transformer (CT) 104, a rectifying part 105, a power source 106, a calculating part 107, an operation current adjusting part 108, an electromagnet 109, and a contact point mechanism 110.

The current transformer (CT) 104 which is converter is arranged to pass through the main circuit 103, and current obtained by the CT 104 is rectified by the rectifying part 105, and power is stored in the power source 106. The rectifying part 105 outputs current information, which is a current value of the rectified current, to the calculating part 107. The calculating part 107 sends a trip signal to the power source 106 if it is determined that the current information input to the calculating part 107 has abnormality such as overcurrent, the power source 106 supplies current to the electromagnet 109, and the electromagnet 109 actuates the contact point mechanism 110 to performs a trip operation, which opens a usually-closed contact point and closes a usually-closed contact point. According to this trip operation, for example, magnetization of a coil provided in the electromagnetic contactor 111 is released by the opening of the usually-closed contact point so that the electromagnetic contactor 111 intercepts an electric connection from a power source of the main circuit to a load and a pilot lamp indicating abnormality is turned on by the closing of the usually-opened contact point to urge a user to intercept the main circuit, thus preventing an accident such as burning-out of the motor.

In addition, the contact point mechanism typically includes one usually-opened contact point (contact point a) and one usually-closed contact point (contact point b), but may include only the usually-closed contact point or a switching contact point (contact point c).

When an automatic reset is set, after a predetermined period of time elapses, the calculating part 107 outputs a reset signal to the power source 106. The power source 106 supplies current to the electromagnet 109, the electromagnet 109 actuates the contact point mechanism 110 to perform a reset operation, which closes the usually-closed contact point and opens the usually-opened contact point.

When a manual reset is set, since an electrical configuration is the same as when the automatic reset is set, after a predetermined period of time elapses, the calculating part 107 outputs the reset signal to the power source 106. Although the power source 106 supplies current to the electromagnet 109 and the electromagnet 109 tries to actuate the contact point mechanism 110, a mechanism provided in the contact point mechanism 110 (which will be described later) prevents the reset operation of the contact point mechanism performed according to an electrical operation of the electromagnet 109 while performing the reset operation mechanically only when the manual reset is set.

In addition, the operation current adjusting part 108 can change a current value determined as abnormality by the calculating part 107, thereby corresponding to motors of various rated currents. The power source 106 has a capacitor, for example, as a main part to store power and the operation current adjusting part 108 has a variable resistor, for example, as a main part to change a current value determined as abnormality by the calculating part 107.

Next, a mechanical structure of the overcurrent relay will be described.

Figure 2:
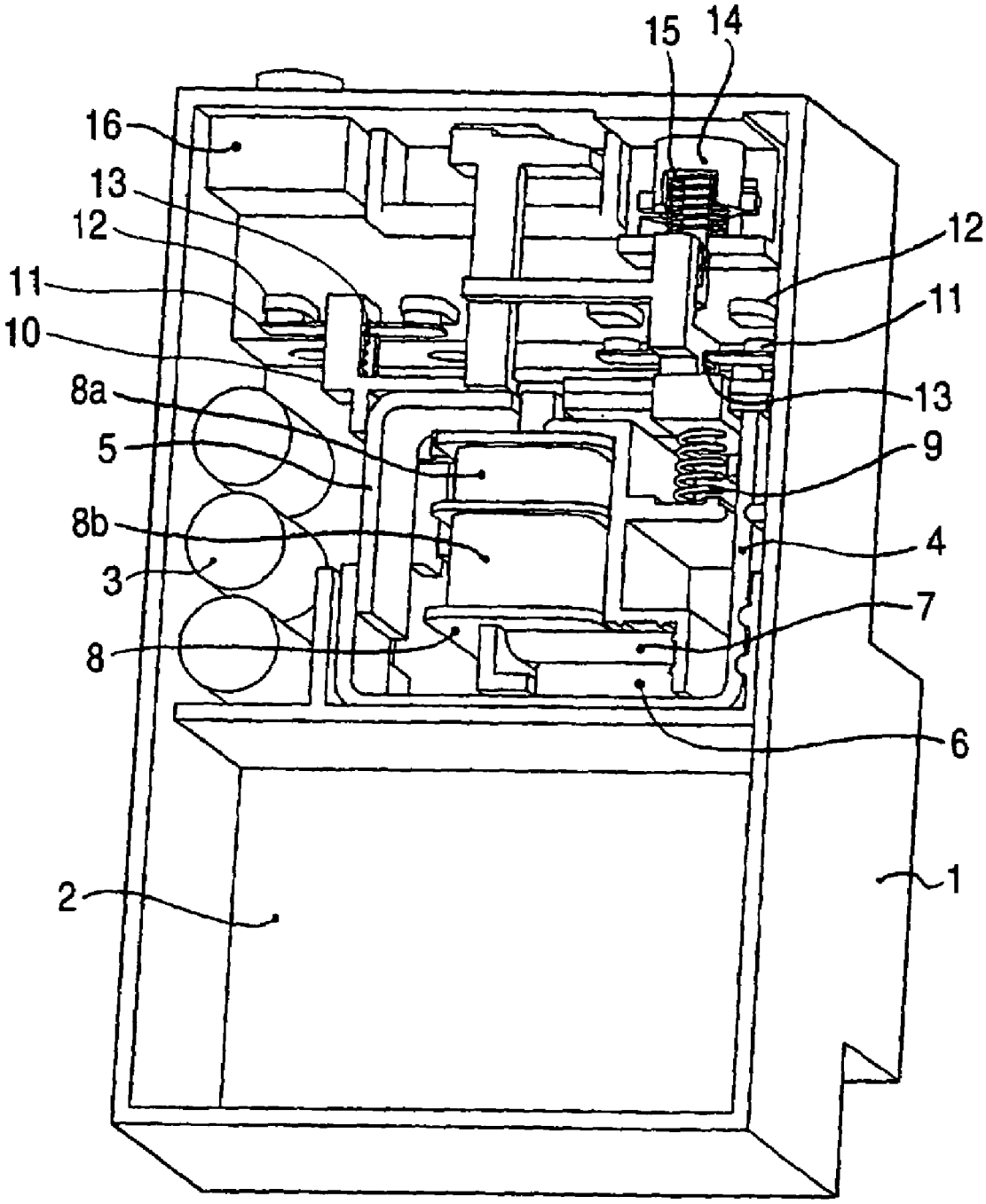
FIG. 2 A view showing a mechanical configuration of the overcurrent relay according to Embodiment 1 of the invention.

FIG. 2 is a view showing a mechanical configuration of the overcurrent relay according to Embodiment 1 of the invention view. As shown in FIG. 2, a CT receptacle 2 of the CT 104 is provided in the bottom of a case 1. In this figure, a mechanical configuration of the CT 104, the rectifying part 105 and the calculating part 107 are not shown. Also, in FIG. 2, a capacitor 3 as a main part of the power source 106 is arranged in the left middle portion of the case 1. The electromagnet 109 is arranged in an approximate central portion of the case 1 and the contact point mechanism 110 is arranged in the top of the case. A variable resistor 16 as a part of the operation current adjusting part 108 to change a current value determined as abnormality by the calculating part 107 is arranged in the left top of the case 1.

Now, a structure of the electromagnet 109 will be described.

As shown in FIG. 2, an outline of a lower side of the electromagnet 109 is constituted by a fixed iron core 4 as a part of a stator and an outline of an upper side of the electromagnet 109 is constituted by a movable iron core 5 composing a movable element. A permanent magnet 6 is installed on a lower portion of the fixed iron core 3. A movable iron core axis 7 composing a part of the stator, which has one end arranged on an upper side of the permanent magnet and the other end engaging with the movable iron core 5 as the movable element, passes through the center of a coil 8 producing a magnetic force when current flows from the capacitor 3 into the coil 8.

Figure 3:
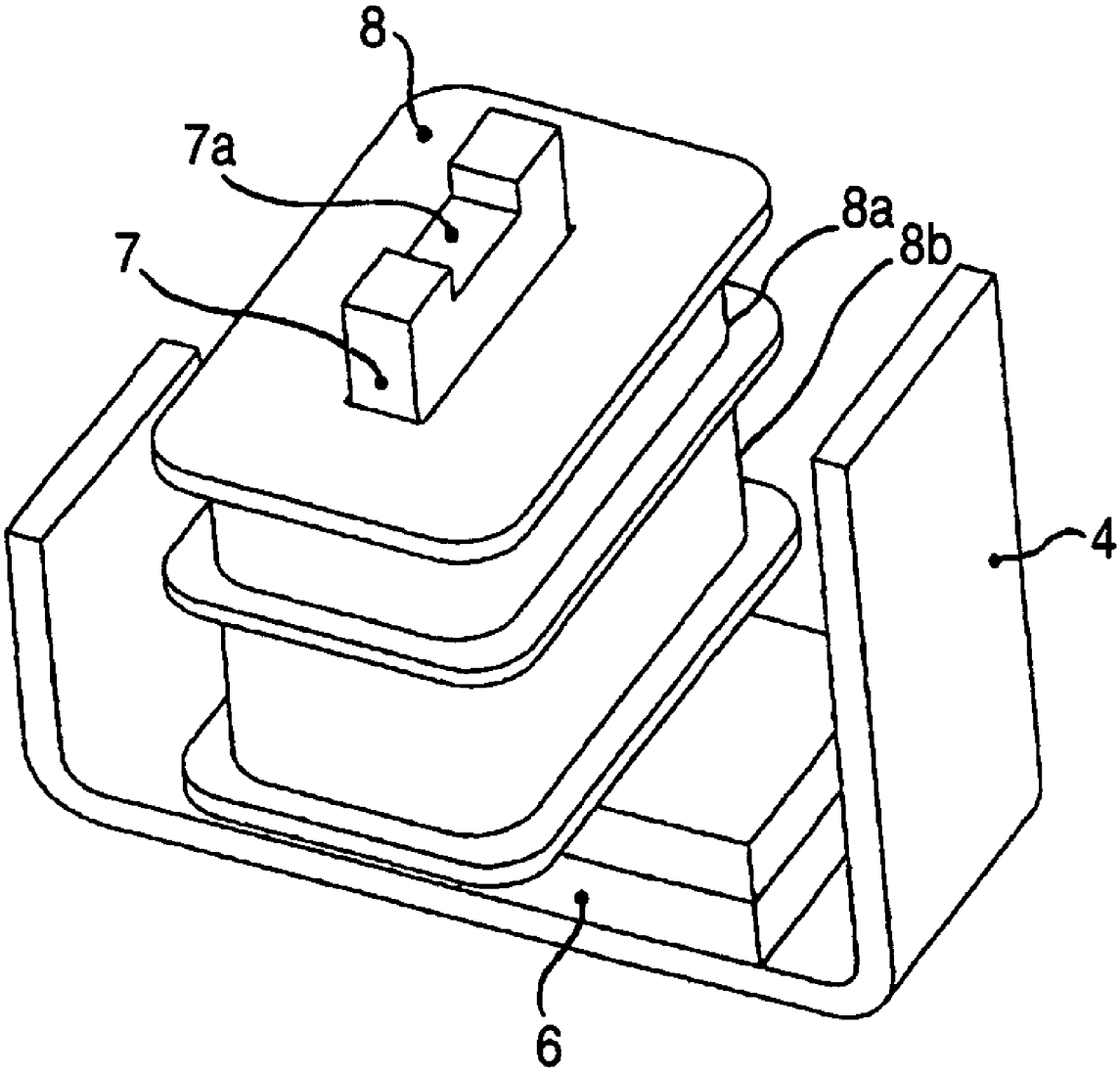
FIG. 3 A view showing configuration of a stator of an electromagnet 109 of the overcurrent relay according to Embodiment 1 of the invention.

FIG. 3 is a view showing configuration of a stator of the electromagnet 109 of the overcurrent relay according to Embodiment 1 of the invention. A groove 7*a* is provided in the central portion of a leading edge at a side of the movable iron core 5 of the movable iron core axis 7 having a plate shape. On the other hand, a narrow part 5*a* is provided in the movable iron core 5 such that it can engage with the groove 7*a* in a fitting manner. Accordingly, the movable iron core 5 is configured to rotate at a predetermined angle around a position at which it engages with the groove 7*a* of the movable iron core axis 7.

In addition, as shown in FIG. 2, a spring 9 having one end fixed to the case 1 and the other end arranged to apply a force upward against an end of the right side of the movable iron core 5. The coil 8 consists of a trip coil 8*a* and a reset coil 8*b*, which are wound to produce magnetic flux opposite to each other by current from the capacitor 3.

In addition, iron pieces composed of the fixed iron core 4 and the movable iron core 5 are arranged in the right and left sides of the coil 8, thereby decreasing a leaking magnetic flux as compared to a case where they are arranged in only one side of both sides.

Now, operation of the electromagnet 109 will be described.

Figure 4A:
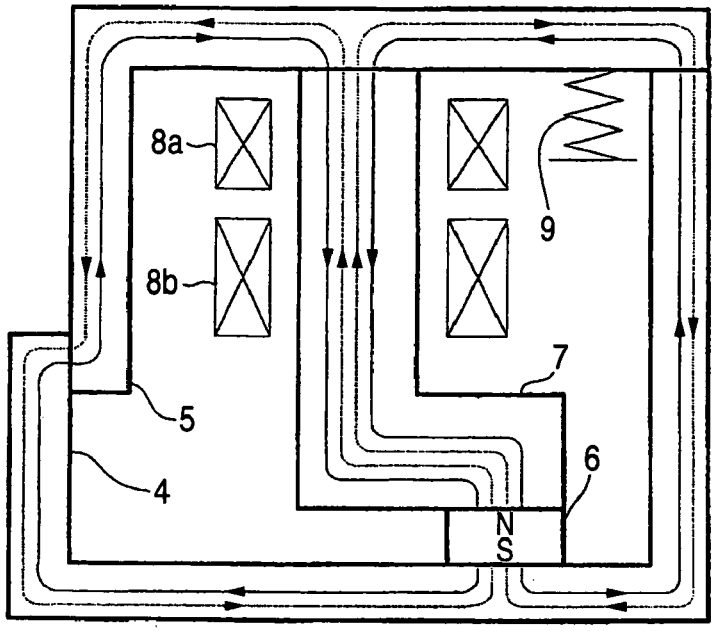
FIG. 4A-4B Operation explanatory views of the electromagnet 109 of the overcurrent relay according to Embodiment 1 of the invention.
Figure 4B:
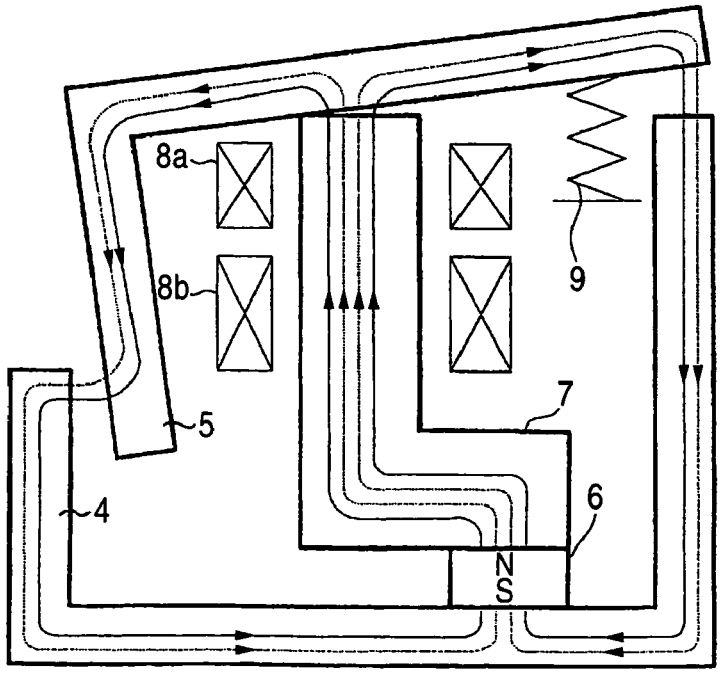

FIGS. 4(*a*) and 4(*b*) are operation explanatory views of the electromagnet 109 of the overcurrent relay according to Embodiment 1 of the invention. FIG. 4(*a*) shows a stationary state and FIG. 4(*b*) shows a trip state.

In the stationary state shown in FIG. 4(*a*), a magnetic flux produced from the permanent magnet 6 returns to the permanent magnet 6 via the movable iron core axis 7, the movable iron core 5, and the fixed iron core 4, as shown by a dotted arrow. A force produced from the mechanical spring 9 acts as the moment toward a direction in which a gap between both ends of the fixed iron core 4 and both ends of the movable iron core 5 by rotating the movable iron core 5 is formed. However, since an absorption force produced by a magnetic flux induced in a magnetic path circuit, which is exerted on the gap, exceeds the moment produced by a resilient force of the spring 9, thereby maintaining an absorption state of the movable iron core 5 and the fixed iron core 4.

If the calculating part 107 determines that the current obtained by the CT 104 and rectified by the rectifying part 105 exceeds a predetermined value since current flowing into the main circuit 103 is large, current flows from the capacitor 3 as the part of the power source 106 into the trip coil 8*a*, thereby producing a magnetic flux (shown by a solid line) opposite to a magnetic flux produced from the permanent magnet 6. Since the magnetic flux of the permanent magnet 6 is opposite to the magnetic flux of the trip coil 8*a*, magnetic fluxes passing through the gap in both ends of the movable iron core 5 and the fixed iron core 4 are cancelled each other, resulting in the reduction of absorption force. In addition, since the moment by the absorption force acting on the gap is smaller than the moment to increase the gap by the resilient force of the spring 9, a trip operation including the rotation of the movable iron core 5 is performed. In the trip state shown in FIG. 4(*b*), since the gap between the movable iron core 5 and the fixed iron core 4 is large, the moment of the absorption force produced by the magnetic flux (shown by a dotted line) produced from the permanent magnet 6 is smaller than the moment produced by the resilient force of the spring 9, thereby maintaining an open state of the movable iron core 5 and the fixed iron core 4.

When the overcurrent relay returns from the trip state to the stationary state, current flows from the capacitor 3 into the reset coil 8*b* as the part of the power source 106, and accordingly, a magnetic flux is produced in the same direction as the magnetic flux produced from the permanent magnet 6. Thus, since the magnetic flux of the reset coil 8*b* has the same direction as the magnetic flux of the permanent magnet 6, a magnetic flux passing through the gap between both ends of the movable iron core 5 and the fixed iron core 4 can be intensified, thereby increasing the absorption force. In addition, as the moment by the absorption exceeds the moment by the resilient force of the spring 9, the overcurrent relay performs the reset operation to return the overcurrent relay from the trip state to the stationary state.

Accordingly, with the structure of the electromagnet 109 in Embodiment 1, since power is consumed by the coil 8 only when the overcurrent relay transfers from the stationary state to the trip state and returns it from the trip state to the stationary state, and power is not consumed in the stationary state and the trip state, it is possible to use the configuration of Embodiment 1 by only securing power required to transfer the overcurrent relay from the stationary state to the trip state and return it from the trip state to the stationary state.

Now, a structure of the contact point mechanism 110 shown in FIG. 2 will be described.

The contact point mechanism 110 includes a movable contactor support 10 fixed to the movable iron core 5, a movable contactor 11, a fixed contactor 12 fixed to the case 1, a spring 13 having one end fixed to the movable contactor support 10 and the other end fixed to the movable contactor 11 for exerting a force on a contact point of the fixed contactor 12 from the movable contactor 11 to ensure contact of the contact point, a reset bar 14 for switching between the automatic reset and the manual reset, and a spring 15 having one end fixed to the case 1 and the other end engaging with the reset bar 14 for upwardly exerting a force on the reset bar 13.

Figure 5A:
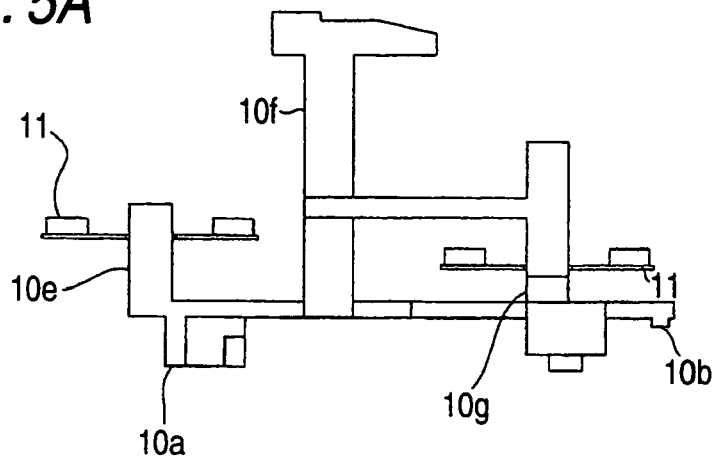
FIG. 5A-5C Structural views of a movable contactor support 10, a movable contactor 11 and a spring 13 of the overcurrent relay according to Embodiment 1 of the invention.
Figure 5B:
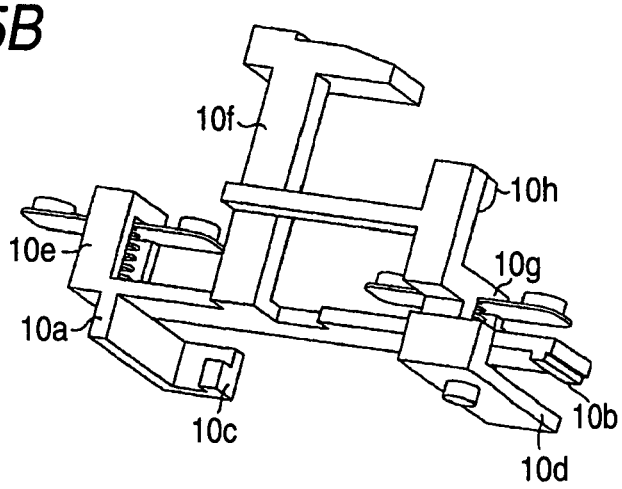
Figure 5C:
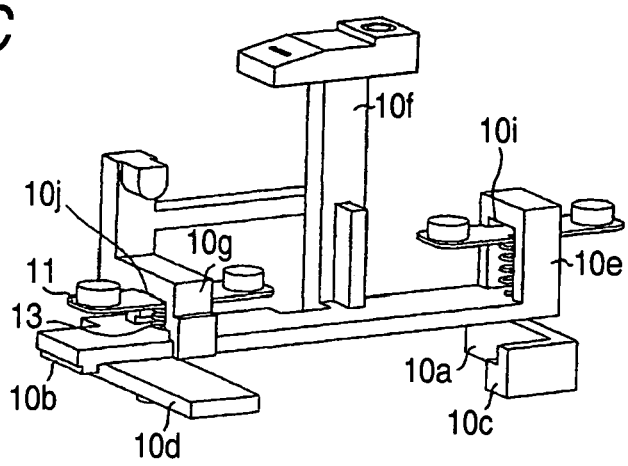

Now, structures of the movable contactor support 10, the movable contactor 11 and the spring 13 will be described. FIGS. 5(*a*) to 5(*c*) are structural views of the movable contactor support 10, the movable contactor 11 and the spring 13 of the overcurrent relay according to Embodiment 1 of the invention. FIG. 5(*a*) is a front view of these parts, FIG. 5(*b*) is a perspective view of these parts when viewed from the bottom of FIG. 5(*a*), and FIG. 5(*c*) is a perspective view of these parts when viewed from the top of FIG. 5(*a*).

Figure 6A:
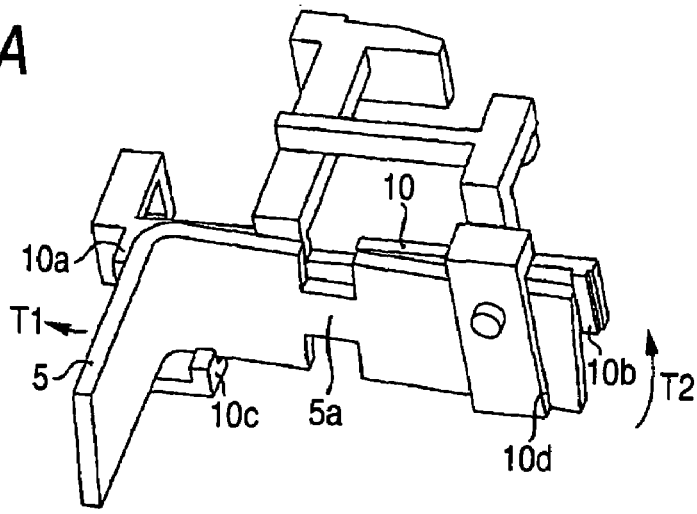
FIGS. 6A-6C Assembly views of the movable contactor support 10 and a movable iron core 5 of the overcurrent relay according to Embodiment 1 of the invention.
Figure 6B:
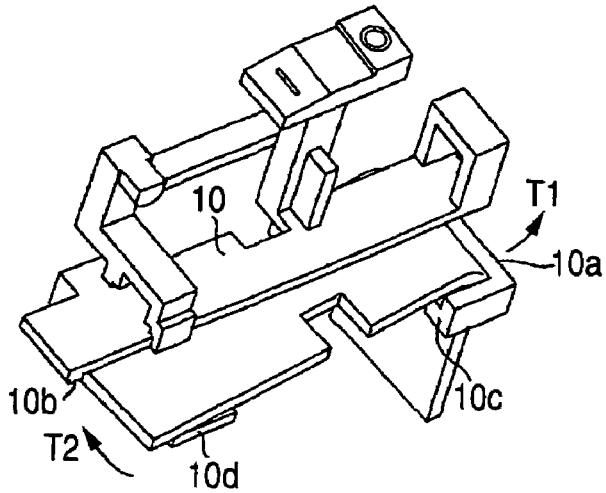
Figure 6C:
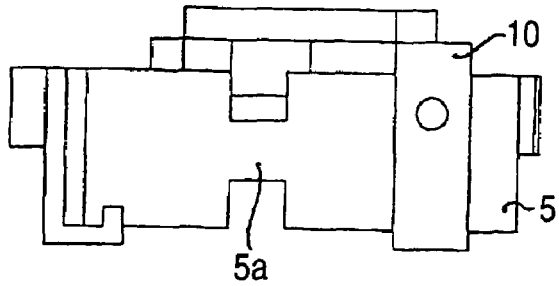

As shown in FIG. 5(*b*), the movable contactor support 10 has two plate-shaped protrusions 10*a* and 10*b* and two L-shaped protrusions 10*c* and 10*d* by which the movable contactor support 10 is engaged with and fixed to the movable iron core 5. FIGS. 6(*a*) to 6(*c*) are assembly views of the movable contactor support 10 and the movable iron core 5 of the overcurrent relay according to Embodiment 1 of the invention. FIG. 6(*a*) is a perspective view of these parts when viewed from a lower direction during assembly, FIG. 6(*b*) is a perspective view of these parts when viewed from an upper direction during assembly, and FIG. 6(*c*) is a lower directional view of these parts after assembly.

As shown in FIGS. 6(*a*) and 6(*b*), first, the movable iron core 5 is obliquely engaged with the movable contactor support 10 while contacting the L-shaped protrusions 10*c* and 10*d*. Then, the movable iron core 5 is rotated in a T2 direction while the plate-shaped protrusion 10*a* is deformed in a T1 direction, and finally, a positional relation between the movable contactor support 10 and the movable iron core 5 is determined and fixed by the plate-shaped protrusions 10*a* and 10*b* and the L-shaped protrusions 10*c* and 10*d* provided in both ends of the movable contactor support 10, as shown in FIG. 6(*c*). Accordingly, the movable iron core 5 is restricted by the movable contactor support 10.

As shown in FIGS. 5(*a*) to 5(*c*), the movable contactor support 10 further includes a protrusion 10*e*, a protrusion 10*f*, and a protrusion 10*g*, and the protrusion 10*g* has a protrusion 10*h* arranged in parallel to a rotation axis of the movable iron core 5. The movable contactor 11 is inserted into windows 10*i* and 10*j* formed in the protrusion 10*e* and the protrusion 10*g* and is pressed against the upper side, that is, in a direction of the fixed contactor 12 shown in FIG. 2, by the spring 13 received in the windows 10*i* and 10*i*.

Referring to FIG. 2 again, in interlock with the movable contactor support 10 fixed to the movable iron core 5, the left movable contactor 11 contacts the left fixed contactor 12 in the stationary state, while the right movable contactor 11 contacts the right fixed contactor 12 in the trip state.

Figure 7A:
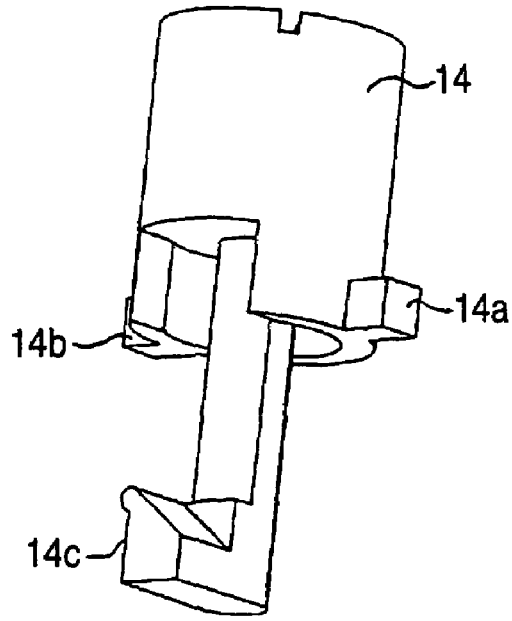
FIG. 7A-7B Structural views of a reset bar 14 of the overcurrent relay according to Embodiment 1 of the invention.
Figure 7B:
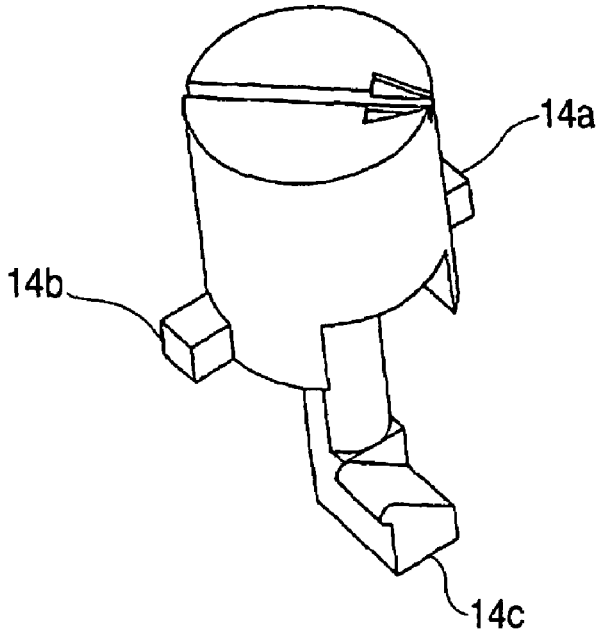
Figure 8:
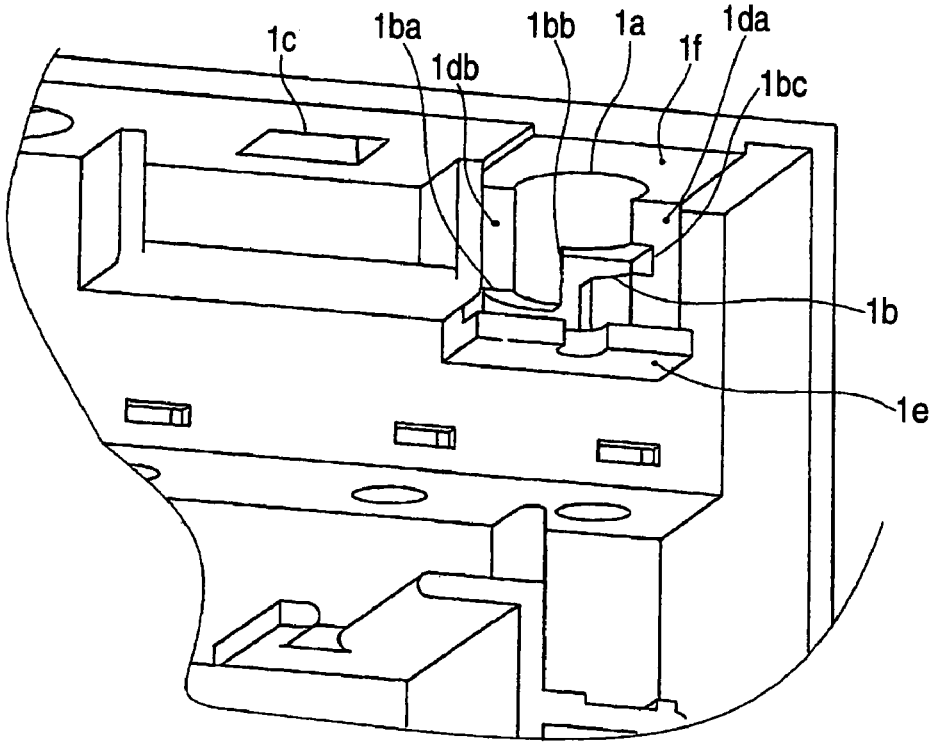
FIG. 8 A partial view of a portion in which the reset bar 14 of a case 1 of the overcurrent relay according to Embodiment 1 of the invention is arranged.
Figure 9A:
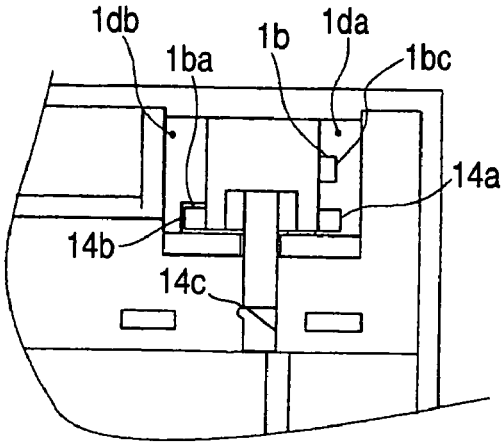
FIG. 9A-9B Views showing a procedure in which the reset bar 14 contained in the case 1 of the overcurrent relay according to Embodiment 1 of the invention is switched to a reset setting position.
Figure 9B:
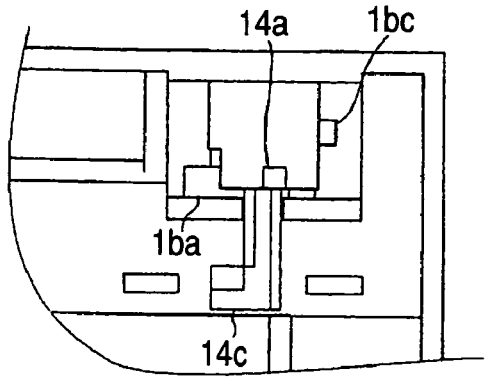
Figure 10B:
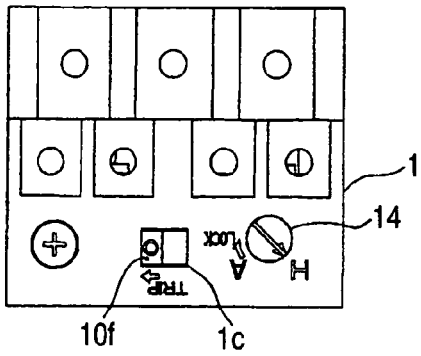
FIG. 10A-10D Views showing a stationary state in manual reset setting of the overcurrent relay according to Embodiment 1 of the invention.
Figure 10C:
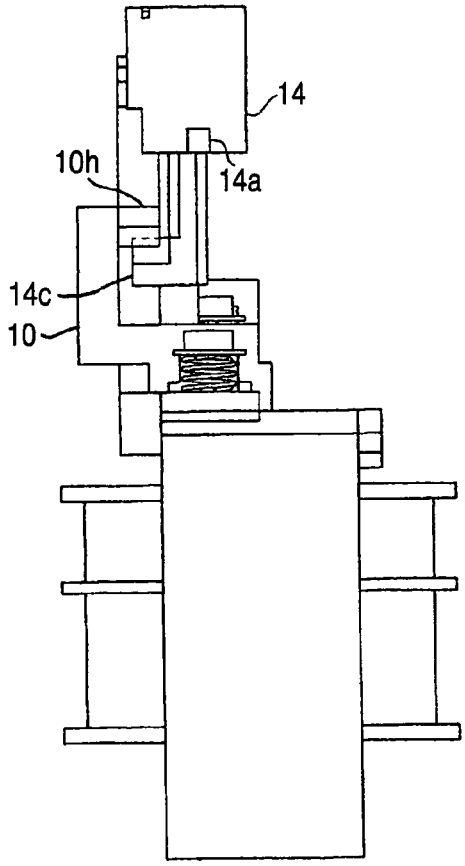
Figure 10A:
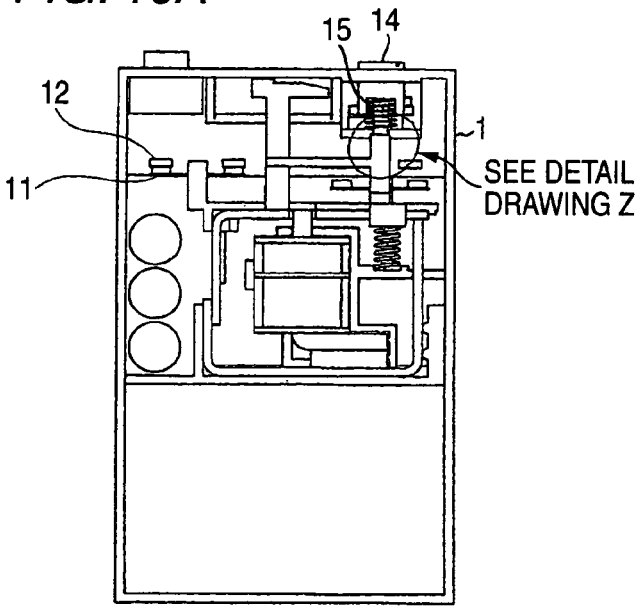
Figure 10D:
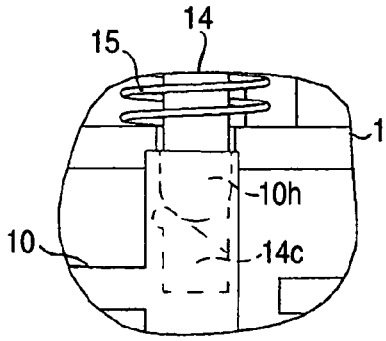

Now, the reset bar 14 for switching between the automatic reset and the manual reset and the spring 15 having one end fixed to the case 1 and the other end engaging with the reset bar 14 for upwardly exerting a force on the reset bar 14 will be described with reference to FIGS. 7(*a*), 7(*b*), 8, 9(*a*), and 9(*b*). FIGS. 7(*a*) and 7(*b*) are structural views of the reset bar 14 of the overcurrent relay according to Embodiment 1 of the invention. FIG. 8 is a partial view of a portion in which the reset bar 14 of the case 1 of the overcurrent relay according to Embodiment 1 of the invention is arranged. FIGS. 9(*a*) and 9(*b*) are views showing a procedure in which the reset bar 14 contained in the case 1 of the overcurrent relay according to Embodiment 1 of the invention is switched to a reset setting position. FIG. 7(*a*) is a perspective view of the reset bar 14 when viewed from the bottom, FIG. 7(*b*) is a perspective view of the reset bar 14 when viewed from the top, FIG. 9(*a*) is a view showing a case where the reset bar 14 is pushed in a downward direction from the stationary state, and FIG. 9(*b*) is a view showing a case where the reset bar 14 is rotated by about 90° with an axis as the direction in which the reset bar 14 is pushed from the state of FIG. 9(*a*).

As shown in FIG. 8, the case 1 is provided with a hole 1*a* into which the reset bar 14 can be inserted.

In the stationary state shown in FIG. 2, the protrusion 14*b* provided in the reset bar 14 is configured to contact a wall 1*db* provided in the case 1 and the protrusion 14*a* provided in the reset bar 14 is configured to contact a wall 1*da* provided in the case 1. As shown in FIG. 9(*a*), as long as the reset bar 14 is not pressed and lowered, the protrusion 14*b* provided in the reset bar 14 is disposed at a position at which it does not engage with a left end 1*ba* of a key-shaped groove 1*b* provided in the case 1. In addition, since the protrusion 14*a* provided in the reset bar 14 is larger than a right end 1*bc* of the key-shaped groove 1*b* provided in the case 1, the right end 1*bc* of the key-shaped groove 1*b* provided in the case 1 does not engage with the protrusion 14*a* provided in the reset bar 14. On this account, when the reset bar 14 is moved in the trip operation at the time of the manual trip setting, which will be described later, (i.e., when the reset bar 14 is upwardly moved in FIG. 10 from a state of FIG. 10 to a state of FIG. 11), since the protrusion 14*a* provided in the reset bar 14 slides in the wall 1*da* provided in the case 1 and the protrusion 14*b* provided in the reset bar 14 is slides into the wall 1*db* provided in the case 1, the reset bar can be moved without incorrect rotation to either the right side or the left side.

In addition, for switching from the manual reset setting to the automatic reset setting, which will be described later, the reset bar 14 is required to be rotated from the state shown in FIG. 9(*a*) to the state shown in FIG. 9(*b*) again. That is, since the switching from the manual reset setting to the automatic reset setting requires two operations, that is, an operation of pushing the reset bar 14 and an operation of rotating the reset bar 14, thus making such switching difficult to be achieved, erroneous change of a setting can be prevented.

Referring to FIG. 2 again, four fixed contactors 12 corresponding to both ends of two movable contactors 11, respectively, are arranged in parallel at the same position, and the left (usually-close side) movable contactor 11 is located at an upper side than the right (usually-open side) movable contactor 11 in the figure. In addition, since a rotation point of the movable iron core 5 on an upper end of the movable iron axis 7 is arranged on a side of the left movable contactor 11, an isolation distance between the right (usually-open side) movable contactor 11 and the fixed contactor 12 in the stationary state becomes equal to an isolation distance between the left (usually-close side) movable contactor 11 and the fixed contactor 12 in the trip state.

Since an isolation distance between conductors depending on a required isolation voltage-resistant is defined in IEC60947-1, an operation range of the movable contactor support 10 is required to satisfy the isolation distance. Accordingly, if there is a difference between the isolation distance between the right (usually-open side) movable contactor 11 and the fixed contactor 12 in the stationary state and the isolation distance between the left (usually-close side) movable contactor 11 and the fixed contactor 12 in the trip state, a larger isolation distance side has a clearance exceeding an allowable difference, thus requiring a space more so much for parts. Making the isolation distances equal may lead to efficient use of the space for parts, because of a need to satisfy the definition from a smaller isolation distance side.

Now, operation of the overcurrent relay will be described.

FIGS. 10(*a*) to 10(*d*) are views showing the stationary state in the manual reset setting of the overcurrent relay according to Embodiment 1 of the invention. FIG. 10(*a*) is a front view of the overcurrent relay, FIG. 10(*b*) is a top view of the overcurrent relay, FIG. 10(*c*) is an enlarged side view showing a portion of the electromagnet 109 and the contact point mechanism 110, and FIG. 10(*d*) is a detailed view of a Z portion of FIG. 10(*a*).

As shown in FIG. 10(*b*), an arrow marked on the top of the reset bar 14 points to a letter 'H' marked on the case 1. That is, a manual (hand) reset is indicated to a user. In addition, a circle is marked on the protrusion 10*f* of the movable contactor support 10 from an angled hole 1*c* provided in the case 1. This indicates the stationary state.

As shown in FIG. 10(*a*), the reset bar 14 is upwardly pressed against the case 1 by the spring 15. However, as shown in FIG. 10(*c*) or 10(*d*), since an inclined plane provided in a protrusion 14*c* of the reset bar 14 contacts and engages with the protrusion 10*h* of the movable contactor support 10, the reset bar 14 is held without being upwardly moved and a position of the stationary state of the reset bar 14 is decided. In addition, at this time, the left movable contactor 11 contacts the left fixed contactor, as shown in FIG. 10(*b*).

Figure 11B:
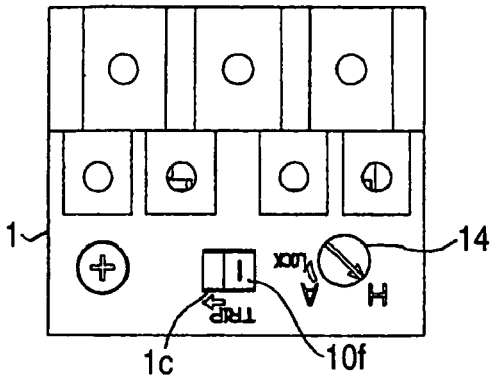
FIGS. 11A-11C Views showing a trip state in the manual reset setting of the overcurrent relay according to Embodiment 1 of the invention.
Figure 11C:
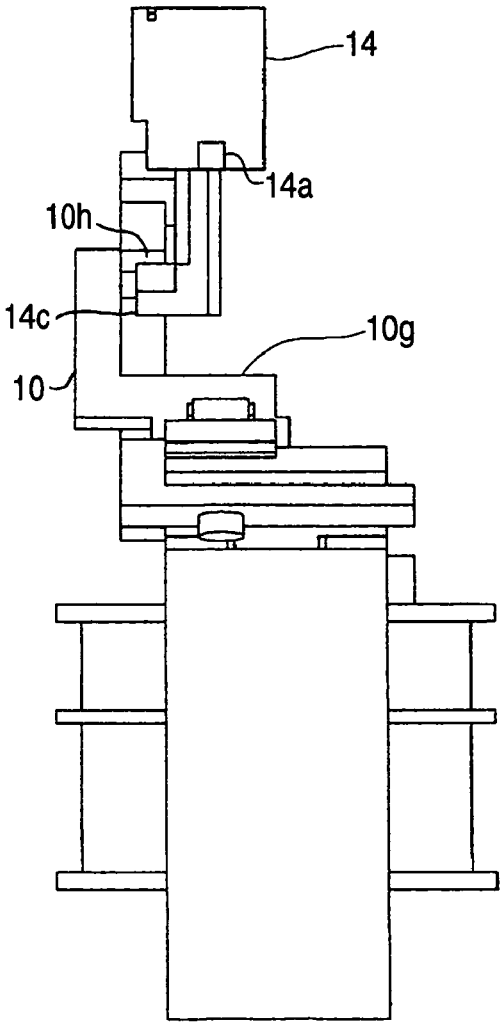
Figure 11A:
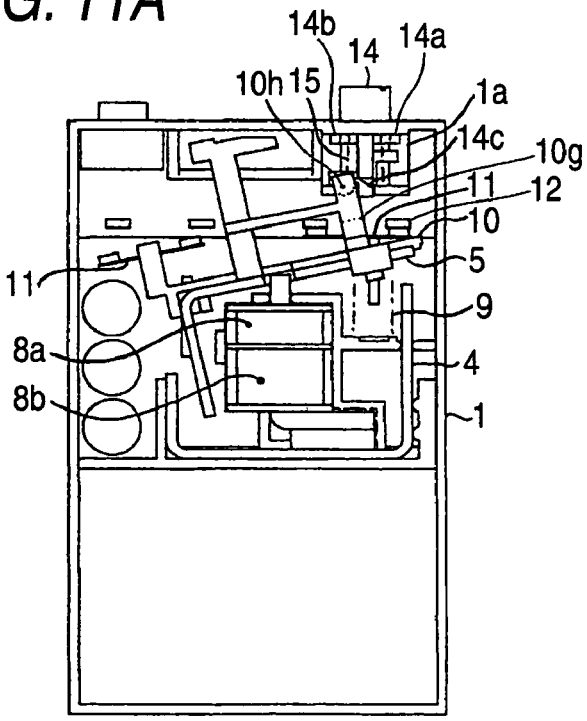

Next, the trip state in the manual reset setting will be described. FIG. 11 is a view showing the trip state in the manual reset setting of the overcurrent relay according to Embodiment 1 of the invention. FIG. 10(*a*) is a front view of the overcurrent relay, FIG. 10(*b*) is a top view of the overcurrent relay, and FIG. 10(*c*) is a side view showing a portion of the electromagnet 109 and the contact point mechanism 110.

When the calculating part 107 detects overcurrent in the stationary state, a magnetic flux is produced from the trip coil 8*a* by current from the capacitor 3 as the part of the power source 106. This produced magnetic flux cancels out a magnetic flux produced by the permanent magnet 6. Accordingly, the moment by the resilient force of the spring 9 becomes larger than the moment by the absorption force produced in the gap between the fixed iron core 4 and the movable iron core 5. As a result, the movable iron core 5 and the movable contactor support 10 fixed to it are rotated in the left direction in FIG. 10(*a*), thus entering into the trip state shown in FIG. 11(*a*). In this trip state, as shown in FIG. 11(*a*), the right movable contactor 11 in FIG. 11(*a*) contacts the fixed contactor 12, while the left movable contactor 11 is detached from, that is, does not contact the fixed contactor 12. In addition, a circle is marked on the protrusion 10*f* of the movable contactor support 10 from the angled hole 1*c* provided in the case 1. This indicates the trip state.

At that time, although the protrusion 10*h* of the movable contactor support 10 is also rotated, since the protrusion 14*c* of the reset bar 14 that contacts a curved surface of the protrusion 10*h* does not rotate, a deviation occurs in a relative position between the protrusions 14*c* and 10*h* such that the protrusion 10*h* of the movable contactor support 10 does not contact the inclined plane of the protrusion 14*c* of the reset bar 14.

At this time, since the inclined plane of the protrusion 14*c* of the reset bar 14 is formed to conform to a rotation locus of the curved surface of the protrusion 10*h* of the movable contactor support 10, little variation occurs when a forces is exerted on the protrusion 10*h* of the movable contactor support 10 and the protrusion 14*c* of the reset bar 14. Accordingly, since a surface pressure of a contact surface between the protrusions 10*h* and 14*c* is small, a sliding area can become small.

When a state of the contact between the protrusion 10*h* of the movable contactor support 10 and the protrusion 14*c* of the reset bar 14 is released, the protrusions 14*a* and 14*b* of the reset bar 14 are pushed up to a position at which the protrusions 14*a* and 14*b* contact a wall if at an upper side of the case 1 by the resilient force of the spring 15 such that the protrusion 14*c* of the reset bar 14 is located on the rotation locus of the protrusion 10*h* of the movable contactor support 10. As a result, even when the moment by the absorption force exerting on the gap between the fixed iron core 4 and the movable iron core 5 becomes larger than the moment by the resilient force of the spring 9 due to the magnetic flux produced from the reset coil 8*c*, the protrusion 10*h* of the movable contactor support 10 interferes with the protrusion 14*c* of the reset bar 14. Accordingly, since contact of the protrusion 14*a* of the reset bar 14 with the wall 1*da* of the case 1 prevents the reset bar 14 from being rotated, rotation of the movable contactor support 10 and the movable iron core 5 engaging with the movable contactor support 10 is suppressed, thus disallowing the overcurrent relay to return to the stationary state shown in FIG. 10(*a*).

In the manual reset setting, in order to return the overcurrent relay from the trip state shown in FIG. 11(*a*) to the stationary state shown in FIG. 10(*a*), the reset bar 14 is pushed in the downward direction in FIG. 11(*a*) such that the protrusion 14*c* of the reset bar 14 is deviated from a lower side on the rotation locus of the protrusion 10*h* of the movable contactor support 10. Accordingly, the protrusion 10*h* of the movable contactor support 10 does not interfere with the protrusion 14*c* of the reset bar 14. At the same time, as the protrusion 14*c* of the reset bar 14 contacts the top of the protrusion 10*g* of the movable contactor support 10 to move the protrusion 10*g* downward, the movable contactor support 10 and the movable iron core 5 are rotated in the right rotation direction to return the overcurrent relay to the stationary state shown in FIG. 10(*a*).

In addition, since there exist the moment by the absorption force exerting on the gap between the fixed iron core 4 and the movable iron core 5 and the moment by the resilient force of the spring 9, if the reset bar 14 is pushed up to a position at which the moment by the absorption force exerting on the gap between the fixed iron core 4 and the movable iron core 5 becomes larger than the moment by the resilient force of the spring 9, without being necessarily pushed up to a sufficient position at which the fixed iron core 4 enters into the stationary state, it is possible to turn the movable iron core 5 and the movable contactor support 10 to the stationary state.

Figure 12B:
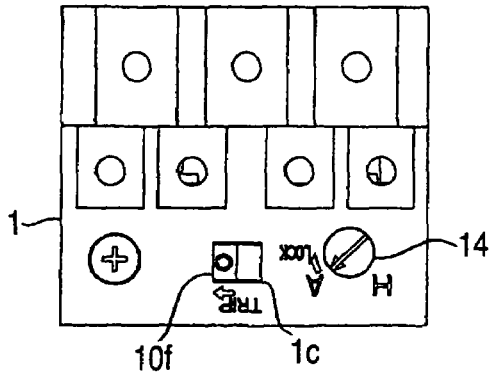
FIGS. 12A-12C Views showing a stationary state in automatic reset setting of the overcurrent relay according to Embodiment 1 of the invention.
Figure 12C:
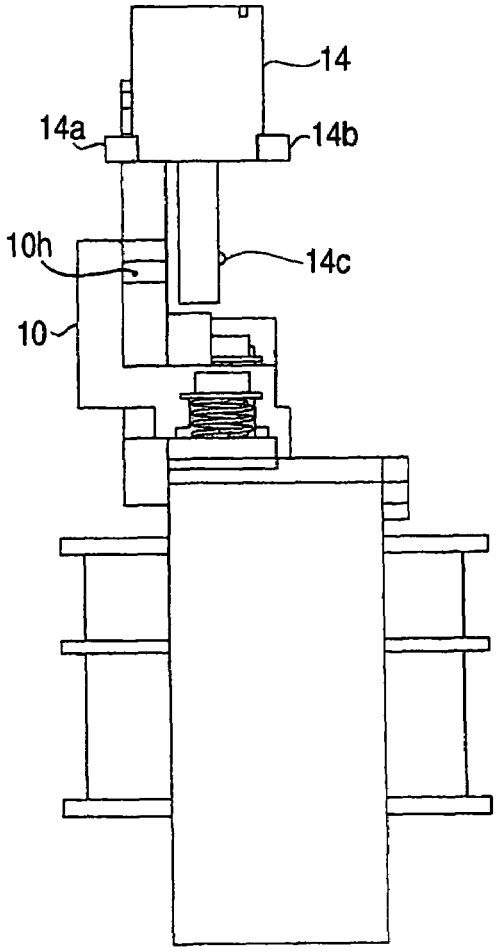
Figure 12A:
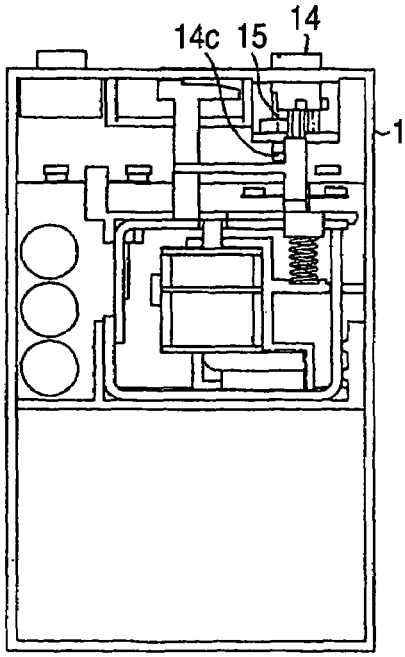

Next, the stationary state in the automatic reset setting will be described. FIGS. 12(*a*) to 12(*c*) are views showing the stationary state in the automatic reset setting of the overcurrent relay according to Embodiment 1 of the invention. FIG. 12(*a*) is a front view of the overcurrent relay, FIG. 12(*b*) is a top view of the overcurrent relay, and FIG. 12(*c*) is a side view showing a portion of the electromagnet 109 and the contact point mechanism 110.

A difference between FIGS. 12(*a*) to 12(*c*) and FIGS. 10(*a*) to 10(*d*) is the position of the reset bar 14. While an arrow marked on the top of the reset bar 14 points to a letter 'H' marked on the case 1 in FIG. 10(*b*), an arrow points to a letter 'A' marked on the case 1 in FIG. 12(*b*). That is, an automatic reset is indicated to a user.

In order to switch the direction of the arrow marked on the top of the reset bar 14 from 'H' to 'A', that is, to switch the overcurrent relay from the manual reset to the automatic reset, the reset bar 14 is pushed down in a downward direction in FIG. 10(*a*) until the protrusion 14*b* of the reset bar 14 reaches a position of the groove 1*ba* provided in the case 1. At the same time, by rotating the reset bar 14 by about 90° for the pushed-down direction as the axis, the reset bar 14 can be moved from the position shown in FIG. 9(*a*) to the position shown in FIG. 9(*b*). Thus, since the protrusion 14*b* of the reset bar 14 conforms to a central portion 1*bb* of the key-shaped groove 1*b* of the case 1, the reset bar 14 is pushed up, along the shape of the central portion 1*bb* of the key-shaped groove 1*b*, by the resilient force of the spring 15, to a position at is which the protrusion 14*c* of the reset bar 14 contacts a wall 1*e* of the case 1. On this account, as shown in FIG. 12(*c*), since the protrusion 14*c* of the reset bar 14 is deviated from the rotation locus of the protrusion 10*h* of the movable contactor support 10, the movable contactor support 10, the movable contactor 11 engaging with it, and the movable iron core 5 engaging with and fixed to the movable contactor support 10 can be freely rotated without being restricted by the reset bar 14.

In the stationary state shown in FIG. 12(*a*) to 12(*c*), when the calculating part 107 detects overcurrent, a magnetic flux produced from the trip coil 8*a* by current from the capacitor 3 as the part of the power source 106 cancels out a magnetic flux produced by the permanent magnet 6. Accordingly, a moment by the resilient force of the spring 9 becomes larger than a moment by the absorption force produced in the gap between the fixed iron core 4 and the movable iron core 5. As a result, the movable iron core 5 and the movable contactor support 10 fixed to it are rotated in the left direction in FIG. 12(*a*), thus entering into the trip state shown in FIG. 13(*a*).

Figure 13B:
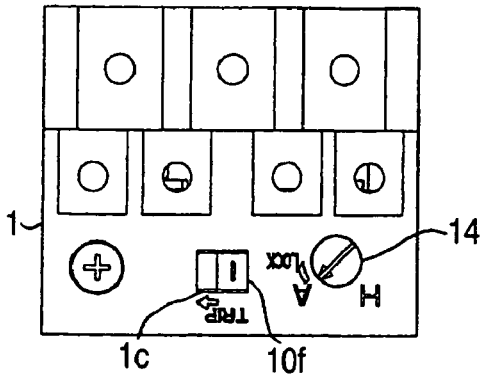
FIGS. 13A-13C Views showing a trip state in the automatic reset setting of the overcurrent relay according to Embodiment 1 of the invention.
Figure 13C:
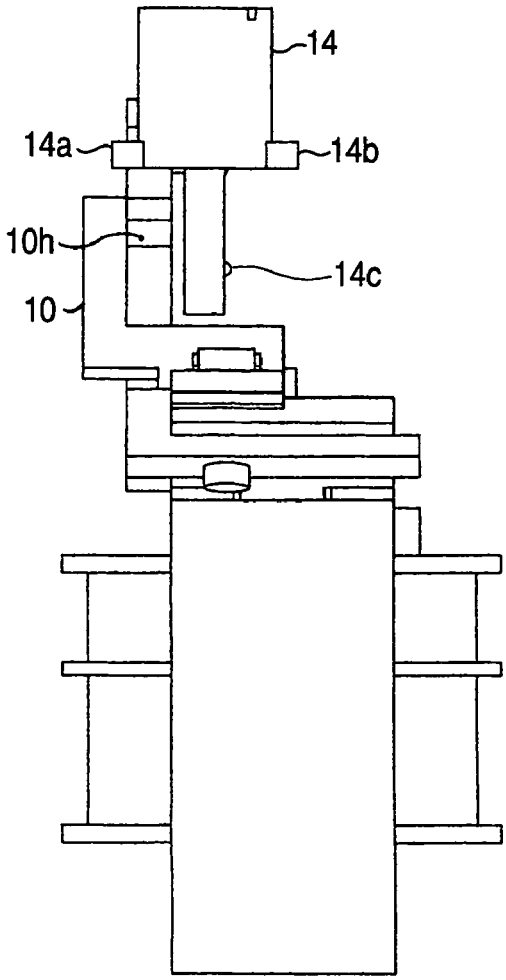
Figure 13A:
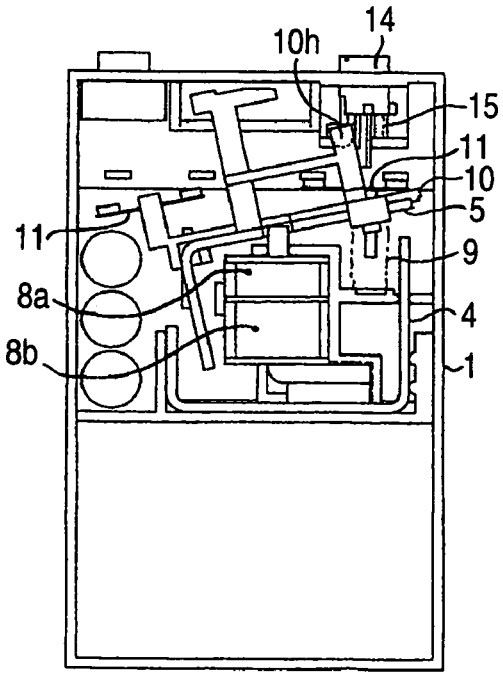

FIGS. 13(*a*) to 13(*c*) are views showing the trip state in the automatic reset setting of the overcurrent relay according to Embodiment 1 of the invention is arranged. FIG. 13(*a*) is a front view of the overcurrent relay, FIG. 13(*b*) is a top view of the overcurrent relay, and FIG. 13(*c*) is a side view showing a portion of the electromagnet 109 and the contact point mechanism 110.

When the calculating part 107 determines that the overcurrent relay returns from the trip state to the stationary state, it processes to flow current from the capacitor 3 as the part of the power source 106 to the rest coil 8*b*. Due to this current, a magnetic flux is produced from the reset coil 8*b* in the same direction as the magnetic flux produced by the permanent magnet 6. Accordingly, the moment by the absorption force exerting on the gap between the fixed iron core 4 and the movable iron core 5 becomes larger than the moment by the resilient force of the spring 9. The movable iron core 5 and the movable contactor support 10 fixed to it can be rotated in the right rotation direction in FIG. 13(*a*), thus returning to the stationary state shown in FIG. 12(*a*), without being restricted by the reset bar 14.

In addition, the reset bar 14 and the protrusion 14*b* of the reset bar 14, as shown in FIGS. 13(*a*) to 13(*c*), are located in the central portion 1*bb* of the groove 1*b* of the case 1. Accordingly, even in the automatic reset setting, when a user presses the reset bar 14 down with a force larger than the resilient force of the spring 15, the reset bar 14 can be moved downward. Thus, depending on the position of the reset bar 14, the movable contactor support 10 can be returned to the stationary state as the protrusion 10*g* of the movable contactor support 10 is moved in contact with the bottom of the reset bar 14. On the other hand, there is a possibility that a user manually returns the overcurrent relay to the stationary state with no intention to do so.

Thus, a mechanism to prevent the overcurrent relay from being returned to the stationary state due to an error by the user in the automatic reset is provided in Embodiment 1 of the invention.

Figure 14B:
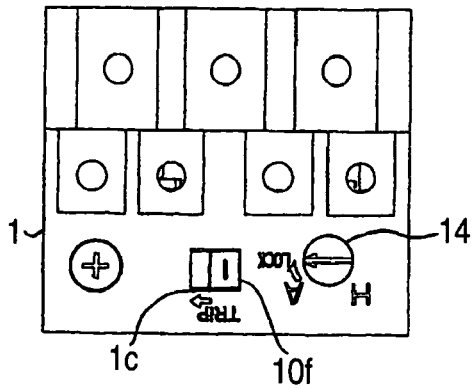
FIG. 14A-14C Views showing a trip state in the automatic reset setting of the overcurrent relay according to Embodiment 1 of the invention.
Figure 14C:
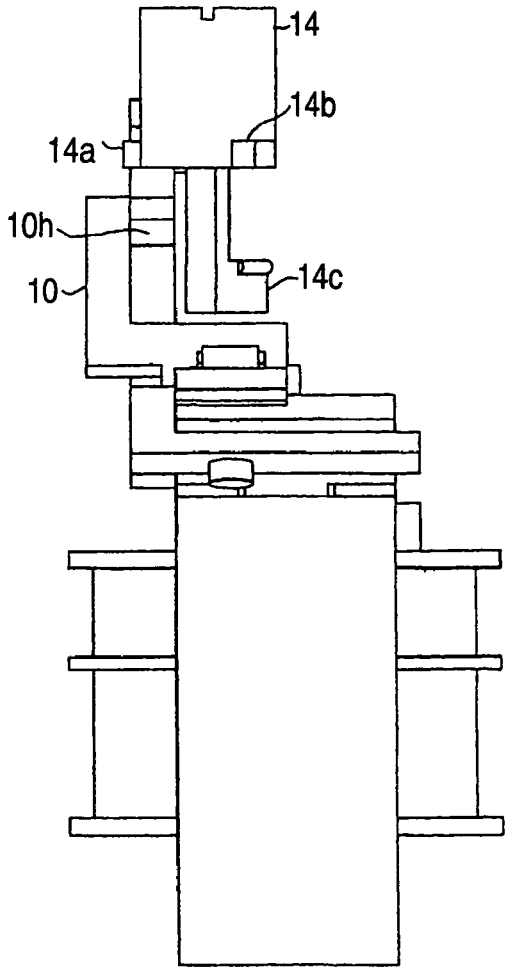
Figure 14A:
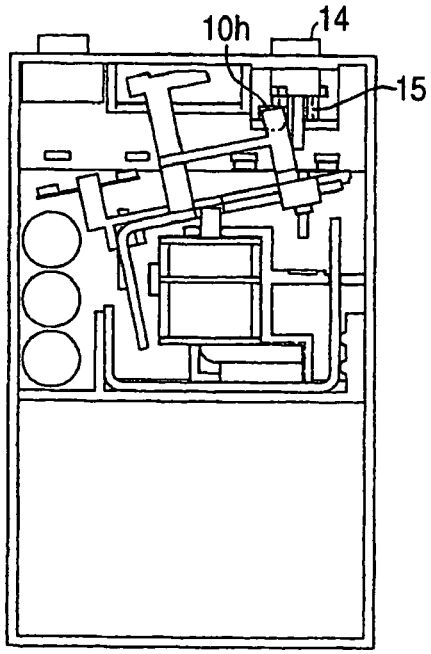

FIGS. 14(*a*) to 14(*c*) are views showing the trip state in the automatic reset setting of the overcurrent relay according to Embodiment 1 of the invention. FIG. 14(*a*) is a front view of the overcurrent relay, FIG. 14(*b*) is a top view of the overcurrent relay, and FIG. 14(*c*) is a side view showing a portion of the electromagnet 109 and the contact point mechanism 110. As shown in FIGS. 14(*a*) to 14(*c*), in order to eliminate a possibility of returning the overcurrent relay to the stationary state manually, the protrusion 14*b* of the reset bar 14 may be moved to the right end 1*bc* of the groove 1*b* of the case 1. In addition, by rotating the reset bar by about 45°, the protrusion 14*b* of the reset bar 14 is moved from the central portion 1*bb* of the groove 1*b* of the case 1 shown in FIG. 8 or 9(*a*) and 9(*b*) to the right end 1*bc*. Since the groove between the central portion 1*bb* of the key-shaped groove 1*b* and the right end 1*bc* and the protrusion 14*b* of the reset bar 14 have only a gap in which the groove and the protrusion 14*b* can be coupled with each other, the reset bar 14 can not be pushed down, thus preventing the reset bar from being set to a manual pushing-in reset by mistake in the automatic reset setting.

According to Embodiment 1, Since the overcurrent relay includes a calculating part 107 for outputting a trip signal or a reset signal to instruct supply and non-supply of power based on current information of a main circuit 103 supplied to a load 102, a power source 106 for supplying power to a coil 8 based on the trip signal or the reset signal when the trip signal or the reset signal is input to the power source, an electromagnet 109 for performing a trip operation to move a movable iron core 5 from a position of a stationary state to a position of a trip state and a reset operation to move the movable iron core 5 from the position of the stationary state to the position of the trip state, the movable iron core 5 including the coil 8 and forming a magnetic circuit when the power is supplied from the power source 106 to the coil 8 based on the trip signal or the reset signal, and a contact point mechanism 110 for opening a usually-closed contact point through the trip operation of the movable iron core 5 and closing the usually-closed contact point through the automatic or manual reset operation, and further, the contact point mechanism 110 includes a movable contactor support 10 for supporting a movable contactor composing a part of the usually-closed contact point while being maintained in the movable iron core 5, and a reset bar 14 arranged in a manner that is switchable between an automatic reset setting and a manual reset setting, wherein the reset bar 14 does not engage with the movable contactor support 10 in an operation range of the movable contactor support 10 in the automatic reset setting, and wherein the reset bar 14 engages with the movable contactor support 10 in interlock with the movable iron core 5 to interrupt the reset operation of the movable iron core 5 of the electromagnet in the manual reset setting, and, when the reset operation is manually performed, engages with the movable contactor support 10 to be moved up to a position at which the reset operation is completed, it is possible to provide an overcurrent relay having less number of parts and a smaller space to implement an automatic reset function and a manual reset function.

In addition, although it is configured in Embodiment 1 that the stationary state and the trip state can be indicated in the angled hole 1*c* by the protrusion 10*f* provided in the movable contactor support 10, such state indication may be achieved by means for recognizing a position of any movable contactor support 10 and means for indicating the states depending on the position even if the state display function does not consist of the angled hole 1*c* and the protrusion 10*f*.

In addition, although it is configured in Embodiment 1 that the magnetic path circuit in the electromagnet 109 has the fixed iron core 4 provided in the left and right sides of the coil 8, the fixed iron core 4 may be provided in only one side of the left or right sides of the coil 8.

In addition, although it is configured in Embodiment 1 that the fixed contactor 12 is plated to reduce contact resistance of a mechanical contact point with the movable contactor 11, any contact points instead of the plating may be used.

Likewise, although it is configured in Embodiment 1 that the movable contactor 11 is provided with contact points, the movable contactor 11 may be plated to reduce contact resistance of a mechanical contact point, instead of the contact points.

In addition, since the movable contactor support 10 can be rotated in the left direction in FIG. 10(*a*) by forcing the protrusion 10*f* to be pushed toward the left side using a tool engaging with a step provided on the top of the protrusion 10*f* of the movable contactor support 10, for a test to confirm operation of the contact point mechanism, that is, a test trip, the contact point mechanism can be manually switched from the stationary state to the trip state.

INDUSTRIAL APPLICABILITY

According to the invention, the electronic self-power feeding overcurrent relay of the invention is adapted for protecting such as a motor from overload and so on.

The invention claimed is:

1. An overcurrent relay comprising:

a calculating unit that outputs a trip signal or a reset signal to instruct supply and non-supply of power based on current information on a main circuit current supplied to a load;

a power source unit that supplies power to a coil based on the trip signal or the reset signal when the trip signal or the reset signal is input;

an electromagnet unit that performs a trip operation to move a movable iron core from a position of a stationary state to a position of a trip state and a reset operation to move the movable iron core from the position of the trip state to the position of the stationary state when the power is supplied from the power source to the coil based on the trip signal or the reset signal; and a contact point mechanism unit that opens a usually-closed contact point through the trip operation of the movable iron core and closes the usually-closed contact point through the automatic or manual reset operation, wherein the movable iron core arranged on sides of the coil and forms a magnetic circuit, and wherein the contact point mechanism unit includes:

a movable contactor support for supporting a movable contactor composing a part of the usually-closed contact point while being maintained in the movable iron core; and a reset bar arranged in a manner that is switchable between an automatic reset setting and a manual reset setting, wherein in the automatic reset setting the reset bar does not engage with the movable contactor support in an operation range of the movable contactor support, and wherein in the manual reset setting the reset bar engages with the movable contactor support in interlock with the movable iron core to interrupt the reset operation of the movable iron core of the electromagnet unit, and when the reset operation is manually performed the reset bar engages with the movable contactor support to be moved up to a position at which the reset operation is completed, and wherein:

in the stationary state in the manual reset setting a position of the reset bar in the stationary state is defined when a protrusion provided in the reset bar on which a resilient force of a spring is exerted engages with a protrusion provided in the movable contactor support, and in the trip state in the manual reset setting when the engagement of the protrusion provided in the reset bar with the protrusion provided in the movable contactor support is released, the reset bar is moved in a direction in which the resilient force of the spring is exerted, and a position of the protrusion provided in the reset bar is defined on a rotation locus of the protrusion provided in the movable contactor support to interrupt the reset operation of the movable contactor support.

2. The overcurrent relay according to claim 1, wherein the protrusion provided in the movable contactor support has a substantially cylindrical shape, and the protrusion provided in the reset bar has an inclined plane along a rotation locus of the substantially cylindrical-shaped protrusion of the movable contactor support.

3. An overcurrent relay comprising:

a calculating unit that outputs a trip signal or a reset signal to instruct supply and non-supply of power based on current information on a main circuit current supplied to a load;

a power source unit that supplies power to a coil based on the trip signal or the reset signal when the trip signal or the reset signal is input;

an electromagnet unit that performs a trip operation to move a movable iron core from a position of a stationary state to a position of a trip state and a reset operation to move the movable iron core from the position of the trip state to the position of the stationary state when the power is supplied from the power source to the coil based on the trip signal or the reset signal; and a contact point mechanism unit that opens a usually-closed contact point through the trip operation of the movable iron core and closes the usually-closed contact point through the automatic or manual reset operation, wherein the movable iron core arranged on sides of the coil and forms a magnetic circuit, and wherein the contact point mechanism unit includes:

a movable contactor support for supporting a movable contactor composing a part of the usually-closed contact point while being maintained in the movable iron core; and a reset bar arranged in a manner that is switchable between an automatic reset setting and a manual reset setting, wherein in the automatic reset setting the reset bar does not engage with the movable contactor support in an operation range of the movable contactor support, and wherein in the manual reset setting the reset bar engages with the movable contactor support in interlock with the movable iron core to interrupt the reset operation of the movable iron core of the electromagnet unit, and when the reset operation is manually performed the reset bar engages with the movable contactor support to be moved up to a position at which the reset operation is completed, wherein the overcurrent relay further comprises:

a case engagement protrusion provided in the reset bar; and a groove provided in a case and engaging with the case engagement protrusion to prevent the reset bar from being manually moved in a direction opposite to a direction in which a resilient force of a spring is exerted in the automatic setting.

* * * * *